US008103199B2

(12) United States Patent
Yasunaga et al.

(10) Patent No.: US 8,103,199 B2
(45) Date of Patent: Jan. 24, 2012

(54) DEVELOPING DEVICE, AND IMAGE FORMING METHOD AND PROCESS CARTRIDGE USING THE DEVELOPING DEVICE

(75) Inventors: Hideaki Yasunaga, Ibaraki (JP); Masayuki Hagi, Minoh (JP); Yoshihiro Mikuriya, Nishinomiya (JP); Yoshitaka Sekiguchi, Nishinomiya (JP); Hiroaki Katoh, Nagaokakyo (JP); Kazuoki Fuwa, Toyonaka (JP); Masahide Inoue, Numazu (JP)

(73) Assignee: Ricoh Company Limited, Tokyo (JP)

( * ) Notice: Subject to any disclaimer, the term of this patent is extended or adjusted under 35 U.S.C. 154(b) by 978 days.

(21) Appl. No.: 12/010,369

(22) Filed: Jan. 24, 2008

(65) Prior Publication Data

US 2008/0175630 A1 Jul. 24, 2008

(30) Foreign Application Priority Data

Jan. 24, 2007 (JP) ..... 2007-013944

(51) Int. Cl.
*G03G 15/08* (2006.01)

(52) U.S. Cl. ..... 399/286; 430/108.4; 399/252

(58) Field of Classification Search ..... None
See application file for complete search history.

(56) References Cited

U.S. PATENT DOCUMENTS

| | | | | |
|---|---|---|---|---|
| 2004/0142268 | A1* | 7/2004 | Yamanouchi et al. | 430/111.4 |
| 2004/0229143 | A1* | 11/2004 | Umemura et al. | 430/108.4 |
| 2005/0214032 | A1* | 9/2005 | Koyanagi et al. | 399/279 |
| 2006/0204882 | A1 | 9/2006 | Nozaki et al. | |
| 2006/0210902 | A1 | 9/2006 | Nakamura et al. | |
| 2006/0275686 | A1 | 12/2006 | Kadota et al. | |
| 2006/0292474 | A1 | 12/2006 | Mikuriya et al. | |
| 2007/0026335 | A1 | 2/2007 | Yamamoto et al. | |
| 2007/0059625 | A1 | 3/2007 | Yamamoto et al. | |
| 2007/0122729 | A1 | 5/2007 | Katoh et al. | |
| 2007/0148568 | A1 | 6/2007 | Kadota et al. | |
| 2007/0190443 | A1 | 8/2007 | Hagi et al. | |
| 2007/0207399 | A1 | 9/2007 | Kadota et al. | |
| 2007/0212630 | A1 | 9/2007 | Yasunaga et al. | |
| 2007/0217842 | A1 | 9/2007 | Kato et al. | |
| 2007/0238042 | A1 | 10/2007 | Yasunaga et al. | |

FOREIGN PATENT DOCUMENTS

| | | |
|---|---|---|
| JP | 2002-304053 | 10/2002 |
| JP | 2003-015401 | 1/2003 |
| JP | 2003-207967 | 7/2003 |
| JP | 2004-157576 | 6/2004 |
| JP | 2006-145956 | 6/2006 |

OTHER PUBLICATIONS

U.S. Appl. No. 11/624,525, filed Jan. 18, 2007, Yasunaga et al.

* cited by examiner

*Primary Examiner* — David Gray
*Assistant Examiner* — Roy Y Yi
(74) *Attorney, Agent, or Firm* — Oblin, Spivak, McClelland, Maier & Neustadt, L.L.P.

(57) ABSTRACT

A developing device including a developing roller facing an image bearing member and a toner layer thickness control member to control an amount of a toner adhered to the developing roller, so that an electrostatic latent image formed on the image bearing member is developed with the toner to form a toner image. The following relationships are satisfied: $0.08\times10^{0.3}\times Dv<Ra<0.18\times10^{0.3}\times Dv$, $2.0<(Ra/RSm)\times100<4.0$, and $8<Rz<15$, where Dv (μm) is a volume average particle diameter of the toner, Ra (μm) is an arithmetical mean roughness of the developing roller in a longitudinal direction, Rz (μm) is a ten-point mean roughness of the developing roller in a longitudinal direction, and RSm (μm) is a mean length of roughness curve elements of the developing roller.

15 Claims, 2 Drawing Sheets

DEVELOPING DEVICE, AND IMAGE FORMING METHOD AND PROCESS CARTRIDGE USING THE DEVELOPING DEVICE

CROSS-REFERENCE TO RELATED APPLICATIONS

This document claims priority and contains subject matter related to Japanese Patent Application No. 2007-013944, filed on Jan. 24, 2007, the entire contents of which are incorporated herein by reference.

BACKGROUND

1. Field of the Invention

The present invention relates to a developing device for use in electrophotography. In addition, the present invention also relates to an image forming method and a process cartridge using the developing device.

2. Discussion of the Background

In electrophotography, an image is typically formed as follows:

(1) an image bearing member (hereinafter a photoconductor, a photoreceptor, a latent image bearing member, etc.) is charged and irradiated to form an electrostatic latent image thereon;

(2) the electrostatic latent image is developed with a toner to form a toner image;

(3) the toner image is transferred onto a recording medium such as a transfer paper; and (4) the toner image is fixed on the recording medium by a heat roller.

Developing methods for use in electrophotography are classified into two-component developing methods using a two-component developer including a toner and a carrier and one-component developing methods using a one-component developer including a toner and no carrier. The two-component developing method is capable of stably producing relatively high quality images. However, there are disadvantages that the carrier easily deteriorates and the mixing ratio of the carrier and the toner largely varies with time. As a result, high quality images cannot be stably produced for a long period of time. The two-component developing method has another disadvantages of having poor maintainability and being large in size. For the above reasons, the one-component developing method has received attention recently.

In the one-component developing method, a toner (i.e., a one-component developer) is transported by at least one toner transport member (hereinafter a developing roller, a toner bearing member, etc.), and develops an electrostatic latent image formed on an image bearing member to form a toner image. A toner layer thickness control member is provided facing the toner transport member. The toner is charged when passing through the toner transport member. It is proposed that the toner layer thickness control member, a blade or a roller, applying pressure to a toner transported onto the toner transport member by facing the toner transport member to control the thickness of the toner layer.

The amount of the toner included in the toner layer formed on the toner transport member, for example, a developing roller, largely varies before and after the toner layer passes through the toner layer thickness control member, depending on the shape and fluidity of the toner. As a result, the charge quantity of the toner also largely varies, and image noises such as fog and density unevenness tend to be caused in the resultant image. Therefore, the toner layer needs to include a constant amount of toner and have a constant charge quantity as much as possible.

For the above reasons, various attempts have been made to improve developing rollers and toners. For example, published unexamined Japanese patent application No. (hereinafter referred to as JP-A) 2006-145956 discloses a developing roller having specific surface roughness properties such as mean spacing of profile irregularities (Sm) and ten-point mean roughness (Rz) and a specific hardness. The ten-point mean roughness (Rz) represents variation in surface roughness of a developing roller, because the ten-point mean roughness (Rz) is the sum of the average height among 5 tallest peaks and the average depth among 5 lowest valleys. However, to transport a toner through the use of concavities on the surface of a developing roller, the degree of surface roughness (i.e., concavity and convexity) of the developing roller may be determined according to the average diameter of the toner, otherwise the toner cannot be stably charged and transported.

JP-A 2003-15401 also discloses a developing roller having specific surface roughness properties such as ten-point mean roughness (Rz), maximum peak (Ry), arithmetical mean roughness (Ra), and mean spacing of profile irregularities (Sm). However, the developing roller has too large a mean spacing of profile irregularities (Sm) to effectively transport a toner by embedding the toner in the concavities on the surface of the developing roller.

JP-A 2002-304053 also discloses a developing roller having specific surface roughness properties such as mean spacing of profile irregularities (Sm) and ten-point mean roughness (Rz). However, as mentioned above, to transport a toner through the use of concavities on the surface of a developing roller, the degree of surface roughness (i.e., concavity and convexity) of the developing roller may be determined according to the average diameter of the toner, otherwise the toner cannot be stably charged and transported.

JP-A 2003-207967 also discloses a developing roller having specific surface roughness properties such as mean spacing of profile irregularities (Sm) and ten-point mean roughness (Rz). However, the developing roller has too large a mean spacing of profile irregularities (Sm) to effectively transport a toner by embedding the toner in the concavities on the surface of the developing roller.

However, the above techniques are not satisfactory to improve chargeability and transportability of the toner. Therefore, the occurrence of fog and density unevenness in the resultant image cannot be prevented.

SUMMARY

Accordingly, the present specification describes a developing device in which a toner can be satisfactorily charged and fed.

The present specification also describes an image forming method and a process cartridge capable of stably producing high quality images without fog and density unevenness.

In a non-limiting embodiment, a developing device, includes: a developing roller provided facing an image bearing member; and a toner layer thickness control member configured to control an amount of a toner adhered to the developing roller, so that an electrostatic latent image formed on the image bearing member is developed with the toner to form a toner image. The following relationships are satisfied in the above developing device:

$$0.08\times10^{0.3}\times Dv<Ra<0.18\times10^{0.3}\times Dv \quad (1)$$

$$2.0<(Ra/RSm)\times100<4.0 \quad (2)$$

$$8<Rz<15 \quad (3)$$

where Dv (μm) represents a volume average particle diameter of the toner, Ra (μm) represents an arithmetical mean roughness of the developing roller in a longitudinal direction, Rz (μm) represents a ten-point mean roughness of the developing roller in a longitudinal direction, and RSm (μm) represents a mean length of roughness curve elements of the developing roller.

The present specification also describes an image forming apparatus and a process cartridge using the above-mentioned developing device.

BRIEF DESCRIPTION OF THE DRAWINGS

A more complete appreciation of the embodiments described herein and many of the attendant advantages thereof will be readily obtained as the same becomes better understood by reference to the following detailed description when considered in connection with the accompanying drawings, wherein.

DETAILED DESCRIPTION (Developing Device)

Figure 1:
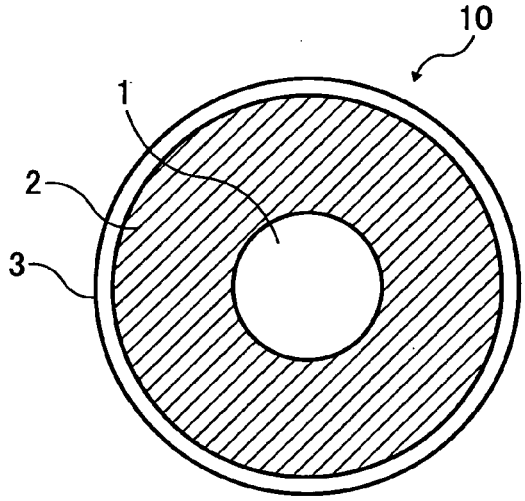
FIG. 1 is a schematic cross-sectional view illustrating an embodiment of a developing roller.

Generally, a non-limiting example of a developing device includes a developing roller provided facing an image bearing member, and a toner layer thickness control member to control the amount of a toner adhered to the developing roller by contacting the developing roller.

The toner adhered to the developing roller, the amount of which is controlled by the toner layer thickness control member, is electrostatically moved onto an electrostatic latent image formed on the image bearing member so that the electrostatic latent image is developed with the toner to form a toner image.

The developing device satisfies the following relationships:

$$0.08\times10^{0.3}\times Dv<Ra<0.18\times10^{0.3}\times Dv \quad (1)$$

$$2.0<(Ra/RSm)\times100<4.0 \quad (2)$$

$$8<Rz<15 \quad (3)$$

wherein Dv (μm) represents a volume average particle diameter of the toner, Ra (μm) represents an arithmetical mean roughness of the developing roller in a longitudinal direction, Rz (μm) represents a ten-point mean roughness of the developing roller in a longitudinal direction, and RSm (μm) represents a mean length of roughness curve elements of the developing roller.

When the Ra is too large, the developing roller has too large a surface roughness compared to the volume average particle diameter of the toner. In this case, too large an amount of the toner is transported, and therefore the toner is insufficiently charged. As a result, background fouling tends to be caused in the resultant images. When Ra is too small, too small an amount of the toner is transported, and therefore the toner is excessively charged. As a result, the resultant image has a lower image density.

When the value ((Ra/RSm)×100) is too large, the developing roller has too small a roughness width or too large a roughness in a lateral direction. In this case, too small an amount of the toner is transported. When the value ((Ra/RSm)×100) is too small, too large an amount of the toner is transported.

The developing roller has a ten-point mean roughness (Rz) in a longitudinal direction of greater than 8 μm and less than 15 μm, and preferably greater than 10 μm and less than 12 μm. When the Rz is too small, too small an amount of the toner is transported, and therefore the resultant image has a lower image density. When the Rz is too large, too large an amount of the toner is transported, and therefore an unevenness image is produced due to the occurrence of toner clogging in the developing part.

The arithmetical mean roughness (Ra) and the ten-point mean roughness (Rz) of a developing roller can be measured using a contact surface roughness measuring instrument SURFCOM (from Tokyo Seimitsu Co., Ltd.) based on JIS B0601-1994.

The developing roller preferably has a mean length (RSm) of roughness curve elements of from 25 to 110 μm, and preferably from 30 to 60 μm.

The mean length (RSm) of roughness curve elements of a developing roller can be determined as follows. A developing roller is observed and photographed by a scanning electron microscope (SEM). Distances between 100 randomly selected particles for forming concavities and convexities are measured from the photograph and averaged.

The toner preferably has a volume average particle diameter (Dv) of from 6 to 10 μm, and more preferably from 7 to 9 μm. When the Dv is too small, it is difficult to remove toner particles remaining on the image bearing member with a cleaning blade, resulting in producing abnormal images having undesired lines. When the Dv is too large, granularity of the resultant half-tone image deteriorates.

The toner preferably has the ratio (Dv/Dn) of the volume average particle diameter (Dv) to the number average particle diameter (Dn) of from 1.8 to 2.5, and more preferably from 2.0 to 2.2. When the ratio (Dv/Dn) is too small, the yield of the toner decreases, resulting in increasing the manufacturing cost. When the ratio (Dv/Dn) is too large, the toner has too large a particle diameter distribution, resulting in deterioration of transportability of the toner.

The volume average particle diameter (Dv) and the number average particle diameter (Dn) of a toner can be determined by the Coulter counter method using an instrument such as COULTER COUNTER TA-II, COULTER MULTISIZER II, and COULTER MULTISIZER III (from Beckman Coulter K. K.).

The developing roller includes a shaft core, an intermediate layer located overlying the outermost surface of the shaft core, and a surface layer located overlying the outermost surface of the intermediate layer.

FIG. 1 is a schematic cross-sectional view illustrating an embodiment of a developing roller.

As illustrated in FIG. 1, a developing roller 10 includes a shaft core 1, an intermediate layer 2 located overlying the outermost surface of the shaft core 1, and a surface layer 3 located overlying the outermost surface of the intermediate layer 2. Further, the developing roller 10 may include a cover layer located overlying the outermost surface of the surface layer 3, including a material easily chargeable to the polarity opposite to that of the toner.

For the shaft core 1, carbon steel, alloy steel, cast iron, conductive resins, etc., can be used. Specific examples of the alloy steel include, but are not limited to, stainless steel, nickel-chromium steel, nickel-chromium-molybdenum steel, chromium steel, chromium-molybdenum steel, and nitriding steel containing Al, Cr, Mo, and/or V. In terms of strength, metallic materials are preferably used. These materials can be rust-proofed by being subjected to a plating treatment or an oxidation treatment. As the plating treatment, an electroplating and an electroless plating are preferable. In terms of dimensional stability, the electroless plating is more preferable.

The intermediate layer includes a rubber material, a conductive agent, and a particulate material for forming concavities and convexities, and optionally includes other material, if desired.

Specific examples of the rubber material include, but are not limited to, polyurethane, silicone rubber, butadiene rubber, isoprene rubber, chloroprene rubber, styrene-butadiene rubber, ethylene-propylene rubber, norbornene rubber, epichlorohydrin rubber, fluorine rubber, and acrylic rubber. These materials can be used alone or in combination. Among these materials, silicone rubbers are preferably used. Among the silicone rubbers, a dimethylsilicone polymer having a vinyl group as a crosslinking site, to which a dimethylsilicone oil is added, is preferably used.

The conductive agent such as an ionic conductive agent and an electronic conductive agent can impart a predetermined conductivity to the intermediate layer.

Specific examples of the ionic conductive agent include, but are not limited to, salts (such as perchlorate, chlorate, hydrochloride, bromate, iodate, hydrofluorobroride, sulfate, alkyl sulfate, carboxylate, sulfonate, $PF_6$ salt, and $BF_4$ salt) of ammoniums (such as tetraethylammonium, tetrabutylammonium, lauryltrimethylammonium, dodecyltrimethylammonium, stearyltrimethylammonium, octadecyltrimethylammonium, hexadecyltrimethylammonium, benzyltrimethylammonium, and modified aliphatic dimethylethylammonium); and salts (such as perchlorate, chlorate, hydrochloride, bromate, iodate, hydrofluorobroride, trifluoromethyl sulfate, sulfonate, $PF_6$ salt, and $BF_4$ salt) of alkaline and alkaline-earth metals (such as lithium, sodium, potassium, and magnesium). These can be used alone or in combination.

Specific examples of the electronic conductive agent include, but are not limited to, carbon black, graphite, conductive metals (e.g., copper, nickel, stainless steel) and alloys thereof, conductive metal oxides (e.g., tin oxide, indium oxide, titanium oxide, zinc oxide, tin-antimony composite oxide), and surface-treated insulating materials to have conductivity. These can be used alone or in combination.

The intermediate layer includes the ionic conductive agent in an amount of from 0.01 to 5 parts by weight, and more preferably 0.05 to 2 parts by weight, based on 100 parts by weight of the rubber material. The intermediate layer includes the electronic conductive agent in an amount of from 0.5 to 50 parts by weight, and more preferably 1 to 40 parts by weight, based on 100 parts by weight of the rubber material.

The intermediate layer preferably includes the particulate material for forming concavities and convexities (i.e., surface roughness) on the surface of the developing roller.

Specific examples of the particulate material include, but are not limited to, silica, alumina, titanium oxide, barium titanate, magnesium titanate, calcium titanate, strontium titanate, iron oxide, copper oxide, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Among these materials, silica and titanium dioxide are preferably used.

The particulate material has a number average particle diameter of from 8 to 12 μm, and more preferably from 9 to 11 μm. When the number average particle diameter is too small, the developing roller has too small a surface roughness in a height direction, and therefore too small an amount of the toner is transported. When the number average particle diameter is too large, the developing roller has too large a surface roughness, and therefore too large an amount of the toner is transported.

The number average particle diameter can be measured using an instrument such as COULTER MULTISIZER II (from Beckman Coulter K. K.), or by observation using a scanning electron microscope (SEM).

The intermediate layer preferably includes the particulate material for forming concavities and convexities in an amount of from 25 to 50% by weight, and more preferably from 30 to 40% by weight. When the amount is too small, too small an amount of concavities and convexities are formed, and therefore too small an amount of the toner is transported. When the amount is too large, the particulate material tends to release from the layer due to insufficient binding force and the developing roller has poor surface roughness.

The intermediate layer may optionally include a filler, a cross-linking agent, a foaming agent, an additive for rubbers, etc., if desired.

The intermediate layer preferably has a thickness of from 0.5 to 10 mm, and more preferably from 1 to 5 mm. When the thickness is too small, the particulate material tends to release from the layer due to insufficient binding force. When the thickness it too large, the developing roller has poor surface roughness regardless of the particle diameter of the particulate material. The intermediate layer may have a desired surface roughness when having the above-mentioned thickness and including the particulate material having a number average particle diameter of from 8 to 12 μm.

The surface layer located overlying the outermost surface of the intermediate layer includes a rubber composition including a rubber material (A), a silane coupling agent (B), etc.

As the rubber material (A), any known rubbers expect for hydrogenated acrylonitrile-butadiene rubbers and fluorine rubbers can be used. Specific examples of the rubber material (A) include, but are not limited to, acrylonitrile butadiene rubber (NBR), acrylic rubber (ACM), butadiene rubber (BR), isoprene rubber (IR), styrene-butadiene rubber (SBR), chloroprene rubber (CR), epichlorohydrin rubber (ECO, CO), and urethane rubber. Among these rubbers, acrylonitrile butadiene rubber (NBR) is preferably used because of having a low hardness.

As the silane coupling agent (B), compounds represented by the following formulae (1) and (2) can be used:

$$Y^1—C_3H_6Si(OC_nH_{2n+1})_3 \quad (1)$$

$$Y^2—Si(OC_2H_4OCH_3)_3 \quad (2)$$

wherein $Y^1$ represents vinyl group, glycidoxy group, mercapto group, amino group, epoxy group, isocyanate group, methacryl group, or a group including the above-mentioned groups; $Y^2$ represents vinyl group; and n represents an integer of 1 or 2.

Specific examples of the silane coupling agent (B) represented by the formula (1) include, but are not limited to, γ-mercaptopropyl trimethoxysilane, γ-(methacryloxypropyl) trimethoxysilane, γ-glycidyloxypropyl trimethoxysilane, N-β(aminoethyl)γ-aminopropyl trimethoxysilane, γ-amino-propyl triethoxysilane, N-phenyl-γ-aminopropyl trimethoxysilane, bispropyl triethoxysilane tetrasulfide, and propyl isocyanate triethoxysilane.

Specific examples of the silane coupling agent (B) represented by the formula (2) include, but are not limited to, vinyltris(β-methoxyethoxy)silane.

These silane coupling agents can be used alone or in combination. Among these silane coupling agents, γ-mercaptopropyl trimethoxysilane is preferably used because of not influencing the conductivity.

The surface layer preferably includes the silane coupling agent (B) in an amount of from 0.01 to 15 parts by weight, and more preferably from 0.1 to 5 parts by weight, based on 100 parts by weight of the rubber material (A). When the amount is too small, the silane coupling agent (B) cannot exert its effect, and therefore the layers easily peel off from one another. When the amount is too large, the surface layer has too large a hardness.

The rubber composition may further include a conductive agent, a foaming agent, a cross-linking agent, a cross-linking accelerating agent, an oil, etc., if desired.

The rubber composition is dissolved in an organic solvent to prepare a surface layer coating liquid. Specific examples of the organic solvent include, but are not limited to, methyl ethyl ketone (MEK), methanol, toluene, isopropyl alcohol, methyl cellosolve, and dimethylformamide. These organic solvents can be used alone or in combination. Among these organic solvents, methyl ethyl ketone (MEK) is preferably used because the rubber composition has good solubility to MEK. The coating liquid preferably has a viscosity of from 0.005 to 6 Pa·s in terms of coating ability.

The surface layer preferably has a thickness of from 3 to 10 μm, and more preferably from 5 to 7 μm.

The developing roller can be prepared as follows, for example. At first, materials for preparing an intermediate layer are kneaded using a kneader to prepare an intermediate layer material mixture. The intermediate layer material mixture is cast into a gap formed between a metallic shaft core and a cylindrical mold. The cylindrical mold is covered with a lid, and subsequently heated for 20 minutes at 150 to 220° C. so that the intermediate layer material mixture is vulcanized. Thus, an intermediate layer is formed. The shaft core having the intermediate layer thereon is demolded from the cylindrical mold, and then the outermost surface of the intermediate layer is activated by a corona discharge treatment, a plasma discharge treatment, etc.

Next, the rubber material (A), the silane coupling agent (B), and optionally other materials, are kneaded with an organic solvent using a kneader. Thus, a surface layer coating liquid is prepared.

The surface layer coating liquid is coated on the outermost surface of the intermediate layer activated by a corona discharge treatment, a plasma discharge treatment, etc. As the coating method, any known coating methods such as a dipping method, a spray method, and a roller coating method can be used. The coated layer is dried and heated. Thus, a surface layer is formed on the outermost surface of the intermediate layer as illustrated in FIG. 1.

The developing roller has a JIS-A hardness not greater than 60 in order not to deteriorate a toner by a pressure concentration at a contact point with a toner layer thickness control member. Since a developing bias is applied to the developing roller so that an electric field is formed between an image bearing member (a photoreceptor), the intermediate layer has a resistance of from $10^3$ to $10^{10}\Omega$. The developing roller rotates in the clockwise direction and transports a toner to points facing the toner layer thickness control member and the photoreceptor.

The surface roughness of the developing roller in a longitudinal direction is preferably controlled by adding a particulate material for forming concavities and convexities in the intermediate layer. A desired surface roughness can be obtained when the intermediate layer has a durable thickness and includes a particulate material having a number average particle diameter of from 8 to 12 μm. When the number average particle diameter is too small, the particulate material may be present near the surface of the intermediate layer, thereby a desired surface roughness can be obtained. However, such a developing roller is difficult to manufacture. When the number average particle diameter is too large, the intermediate layer may have a larger thickness, thereby a desired surface roughness can be obtained. However, it is not preferable for the intermediate layer to have too large a thickness because of having a function as a developing electrode. It is most preferable to control the surface roughness by using a particulate material having a number average particle diameter of from 8 to 12 μm. The thickness of the intermediate layer is typically controlled by the speed of revolution of a coating rotor of a coater and the viscosity of a coating liquid, when formed by a coating method. When the speed of revolution is high and/or the viscosity is low, a thin layer may be formed. When the speed of revolution is low and/or the viscosity is high, a thick layer may be formed.

The surface roughness of the developing roller in a lateral direction is controlled by uniformly dispersing the particulate material for forming concavities and convexities in the intermediate layer. When the intermediate layer includes the particulate material in an amount of about 30% by weight, the particulate material can be prevented from aggregating and uniformly dispersed in the layer.

The toner layer thickness control member is provided on a lower position than a contacting point of a supply roller with the developing roller. The toner layer thickness control member is composed of a metallic platy spring material such as a stainless steel (SUS) and phosphor bronze, and the free end thereof is pressed on the surface of the developing roller with a pressing force of from 10 to 40 N/m. When toner particles pass through the metallic platy spring material upon application of the pressing force, a thin toner layer is formed on the developing roller and the toner particles are friction-charged. Further, a control bias having a value in which the developing bias is offset in the same direction as the charge polarity of the toner is applied to the toner layer thickness control member in order to assist friction-charging toner particles.

The supply roller is provided so that a toner is supplied to the developing roller.

(Toner)

The toner used may include a mother toner comprising a binder resin and a colorant, and an external additive, and optionally includes other materials, if desired.

The mother toner can be prepared by the following methods, for example;

(1) a pulverization method including melt-mixing toner components such as a colorant, a charge controlling agent, and are lease agent with a thermoplastic resin (i.e., a binder resin) so that a toner composition in which the toner components are uniformly dispersed in the binder resin is prepared, pulverizing the toner composition, and classifying the pulverized toner composition;

(2) a suspension polymerization method including dissolving or dispersing toner components such as a colorant, a charge controlling agent, and a release agent, and a polymerization initiator in a monomer (i.e., a raw material of a binder resin) to prepare a toner components mixture, dispersing the toner components mixture in an aqueous medium containing a dispersion stabilizer to prepare a suspension, heating the suspension to a predetermined temperature so that a suspension polymerization is started, filtering the suspension after the suspension polymerization is terminated, washing the filtered suspension, and removing water from the washed suspension and drying;

(3) an emulsion aggregation method including aggregating primary particles of a binder resin having a polar group and formed by an emulsion polymerization and toner components such as a colorant, a charge controlling, and a release agent to form secondary particles in an emulsion, associating the secondary particles by agitating the emulsion at a temperature higher than the glass transition temperature of the binder resin, and filtering and drying the emulsion; and (4) a phase-inversion emulsification method including dissolving or dispersing a resin (i.e., a binder resin) having a hydrophilic group and toner components such as a colorant, a charge controlling, and a release agent in an organic solvent to prepare a toner components mixture, phase-inversion emulsifying the toner components mixture in an aqueous medium to prepare an emulsion by neutralizing the binder resin, and drying the emulsion.

In the pulverization method, as mentioned above, toner components comprising a binder resin and a colorant are melt-kneaded, the kneaded mixture is pulverized, and the pulverized mixture is classified, to prepare a mother toner. In particular, the toner components are mixed to prepare a mixture, and then the mixture is melt-kneaded using a melt-kneader. As the melt-kneader, single-screw or twin-screw continuous kneaders and batch-type kneaders such as a roll mill can be used. Specific examples of the melt-kneader include, but are not limited to, TWIN SCREW EXTRUDER KTK from Kobe Steel, Ltd., TWIN SCREW COMPOUNDER TEM from Toshiba Machine Co., Ltd., MIRACLE K.C.K from Asada Iron Works Co., Ltd., TWIN SCREW EXTRUDER PCM from Ikegai Co., Ltd., and KOKNEADER from Buss Corporation. The melt-kneading process should be performed such that the molecular chain of the binder resin is not cut. In particular, the melt-kneading temperature should be determined considering the softening point of the binder resin. When the melt-kneading temperature is too much lower than the softening point of the binder resin, the molecular chain is cut. When the melt-kneading temperature is too much higher than the softening point of the binder resin, toner constituents cannot be well dispersed.

In the pulverization process, the kneaded mixture is pulverized. The kneaded mixture is preferably coarsely pulverized at first, and subsequently finely pulverized. Suitable pulverization methods include a method in which particles collide with a collision board in a jet stream; a method in which particles collide with each other in a jet mill; and particles are pulverized in a narrow gap formed between a mechanically rotating rotor and a stator; etc.

In the classification process, the pulverized particles are classified so as to have a desired particle diameter. In particular, ultrafine particles are removed using a cyclone, a decanter, a centrifugal separator, etc.

After being subjected to the pulverization and classification process, particles are classified by flowing into a jet air due to centrifugal force. Thus, a mother toner having a desired particle diameter can be prepared.

Next, an external additive is mixed with the mother toner. The mother toner and the external additive are mixed and agitated using a mixer, thereby the external additive is ground while covering the surface of the mother toner. In order to improve durability of the resultant toner, the external additive (e.g., particulate inorganic material, particulate resin) is preferably strongly adhered to the mother toner.

As the binder resin of the toner, any known resins such as polyester resins, (meth)acrylic resins, styrene-(meth)acrylic copolymer resins, epoxy resins, and COCs (i.e., cyclic olefin resins such as TOPAS-COC from Ticona) can be used. From the viewpoint of improving stress resistance in a developing device, polyester resins are preferably used. These resins can be used alone or in combination.

As the polyester resin, a polyester resin formed from a polycondensation reaction between a polyol and a polycarboxylic acid can be used.

Specific examples of diols include, but are not limited to, alkylene oxide adducts of bisphenol A (e.g., polyoxypropylene(2,2)-2,2-bis(4-hydroxyphenyl)propane, polyoxypropylene(3,3)-2,2-bis(4-hydroxyphenyl)propane, polyoxypropylene(6)-2,2-bis(4-hydroxyphenyl)propane, polyoxyethylene (2,0)-2,2-bis(4-hydroxyphenyl)propane), ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polytetramethylene glycol, bisphenol A, and hydrogenated bisphenol A.

Specific examples of polyols having three or more valences include, but are not limited to, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Specific examples of dicarboxylic acids include, but are not limited to, maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, isooctenylsuccinic acid, n-octylsuccinic acid, isooctylsuccinic acid, and anhydrides and lower alkyl esters thereof.

Specific examples of polycarboxylic acids having three or more valences include, but are not limited to, 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and anhydrides and lower alkyl esters thereof.

As the polyester resin, a resin (hereinafter referred to as a vinyl polyester resin) obtained by subjecting raw material monomers of a polyester resin, raw material monomers of a vinyl resin, and a monomer capable of reacting with both of the raw material monomers, to a polycondensation reaction for preparing a polyester resin and a radical polymerization reaction for preparing a vinyl resin, in a reaction vessel at the same time, is also preferably used. The monomer capable of reacting with both of the raw material monomers is, in other words, a monomer capable of both polycondensation reaction and radical polymerization reaction. Such a monomer includes a carboxyl group capable of polycondensation reaction and a vinyl group capable of radical polymerization reaction. Specific examples of such monomers include, but are not limited to, fumaric acid, maleic acid, acrylic acid, and methacrylic acid.

As the raw material monomers of a polyester resin, the above-mentioned polyols and polycarboxylic acids can be used. Specific examples of the raw material monomers of a vinyl resin include, but are not limited to, styrenes and styrene derivatives (e.g., o-methylstyrene, m-methylstyrene, p-methylstyrene, α-methylstyrene, p-ethylstyrene, 2,4-dimethylstyrene, p-tert-butylstyrene, p-chlorostyrene), ethylene-based unsaturated monoolefins (e.g., ethylene, propylene, butylene, isobutylene), alkyl esters of methacrylic acids (e.g., methyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-(methyl)butyl methacrylate, hexyl methacrylate, octyl methacrylate, nonyl methacrylate, decyl methacrylate, undecyl methacrylate, dodecyl methacrylate), alkyl esters of acrylic acids (e.g., methyl acrylate, n-propyl acrylate, isopropyl acrylate, n-butyl acrylate, isobutyl acrylate, t-butyl acrylate, n-pentyl acrylate, isopentyl acrylate, neopentyl acrylate, 3-(methyl)butyl acrylate, hexyl acrylate, octyl acrylate, nonyl acrylate, decyl acrylate, undecyl acrylate, dodecyl acrylate), unsaturated carboxylic acids (e.g., acrylic acid, methacrylic acid, itaconic acid, maleic acid), acrylonitrile, maleates, itaconates, vinyl chloride, vinyl acetate, vinyl benzoate, vinyl methyl ethyl ketone, vinyl hexyl ketone, vinyl methyl ether, vinyl ethyl ether, and vinyl isobutyl ether.

Specific examples of polymerization initiators for polymerizing the raw material monomers of a vinyl resin include, but are not limited to, azo or diazo polymerization initiators (e.g., 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile), and peroxide polymerization initiators (e.g., benzoyl peroxide, dicumyl peroxide, methyl ethyl ketone peroxide, isopropyl peroxycarbonate, lauroyl peroxide).

From the viewpoint of improving separativeness from a fixing roller and hot offset resistance of the resultant toner, the following first and second resins are preferably used as the binder resin.

As a first resin, a polyester resin formed from a polycondensation reaction between a polyol and a polycarboxylic acid is preferably used. In particular, a polyester resin obtained by using an alkylene oxide adduct of bisphenol A as the polyol and terephthalic acid and fumaric acid as the polycarboxylic acid is more preferably used.

As a second resin, a vinyl polyester resin particularly obtained by using an alkylene oxide adduct of bisphenol A, terephthalic acid, trimellitic acid, and succinic acid as the raw material monomers of a polyester resin; styrene and butyl acrylate as the raw material monomers of a vinyl resin; and fumaric acid as the monomer capable of both polycondensation reaction and radical polymerization reaction is preferably used.

The first resin preferably internally contains a hydrocarbon wax. Such a first resin can be obtained by reacting raw material monomers in the presence of the hydrocarbon wax. For example, the hydrocarbon wax is mixed with an acid monomer and an alcohol monomer composing a first resin (i.e., polyester resin), and then the monomers are subjected to a polycondensation reaction. When the second resin (i.e., vinyl polyester resin) internally contains a hydrocarbon wax, the hydrocarbon wax is mixed with raw material monomers of a polyester resin while the mixture is agitated and heated, and then raw material monomers of a vinyl resin are dropped therein, thereby the monomers are subjected to a polycondensation reaction and a radical reaction at the same time.

Specific examples of the colorants include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, etc. These materials can be used alone or in combination.

The toner preferably includes a colorant in an amount of from 1 to 15% by weight, and more preferably from 3 to 10% by weight. When the amount is too small, the coloring power of the toner deteriorates. When the amount is too large, the colorant cannot be well dispersed in the toner, resulting in deterioration of the coloring power and electric properties of the toner.

The colorant can be combined with a resin to be used as a master batch. Specific examples of the resin for use in the master batch include, but are not limited to, the above-mentioned binder resins, styrene polymers and substituted styrene polymers (e.g., polystyrenes, poly-p-chlorostyrenes, polyvinyltoluenes), styrene copolymers (e.g., styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butylmethacrylate copolymers, styrene-methyl α-chloro methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic acid ester copolymers), polymethyl methacrylates, polybutyl methacrylates, polyvinyl chlorides, polyvinyl acetates, polyethylenes, polypropylenes, polyesters, epoxy resins, epoxy polyol resins, polyurethanes, polyamides, polyvinyl butyrals, polyacrylic acids, rosins, modified rosins, terpene resins, aliphatic or alicyclic hydrocarbon resins, aromatic petroleum resins, chlorinated paraffins, paraffin waxes, etc. These resins can be used alone or in combination.

In order to improve separativeness of a recording medium from a fixing member in the fixing process, the toner may include a wax.

Any known waxes can be used. Specific examples of the wax include, but are not limited to, polyolefin waxes (e.g., polyethylene wax, polypropylene wax), hydrocarbons having a long chain (e.g., paraffin wax, SASOL wax), and waxes having a carbonyl group.

Specific examples of the waxes having a carbonyl group include, but are not limited to, esters of polyalkanoic acids (e.g., carnauba wax, montan wax, trimethylolpropane tribehenate, pentaerythritol tetrabehenate, pentaerythritol diacetate dibehenate, glycerin tribehenate, 1,18-octadecanediol distearate); polyalkanol esters (e.g., tristearyl trimellitate, distearyl maleate); polyalkanoic acid amides (e.g., ethylenediamine dibehenyl amide); polyalkylamides (e.g., trimellitic acid tristearylamide); and dialkyl ketones (e.g., distearyl ketone).

The wax preferably has a melting point from 65 to 115° C., and more preferably from 70 to 90° C. When the melting point is too low, fluidity of the toner deteriorates and toner blocking is caused when the toner is preserved. When the melting point is too high, separativeness of the toner in the fixing process deteriorates.

The melting point of a wax can be measured using a differential scanning calorimeter such as DSC-210 (from Seiko Instrument Inc.), for example. An endothermic curve is obtained by heating a sample to 200° C. at a temperature rising rate of 10° C./min, and subsequently cooling to 0° C. at a temperature decreasing rate of 10° C./min. A temperature at which the maximum peak of the heat of fusion is observed in the endothermic curve obtained in the temperature rising scan is defined as the melting point of the sample.

The toner preferably includes the wax in an amount of from 3 to 15 parts by weight, and more preferably 4 to 12 parts by weight, based on 100 parts by weight of the binder resin. When the amount is too small, the wax cannot exert its effect of separating the toner from a fixing member, and therefore hot offset tends to occur. When the amount is too large, the wax tends to release from the surface of the toner when the toner is agitated in the developing device, and adheres to the toner layer thickness control member and/or the image bearing member. Since the wax melts at low temperatures, the wax is easily influenced upon application of thermal or mechanical energy. Therefore, the resultant image tends to have image noises.

The toner may optionally include a charge controlling agent. When a colored material is used as the charge controlling agent, the color tone of a toner tends to change. Therefore, a colorless or a whitish material is preferably used as the charge controlling agent.

Specific examples of the charge controlling agent include any known charge controlling agents such as triphenylmethane dyes, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, and metal salts of salicylic acid and salicylic acid derivatives, but are not limited thereto. These can be used alone or in combination.

Specific examples of commercially available usable charge controlling agents include, but are not limited to, BONTRON® P-51 (quaternary ammonium salt), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; quinacridone, azo pigments, and polymers having a functional group such as a sulfonate group, a carboxyl group, and a quaternary ammonium group.

The content of the charge controlling agent is determined depending on the species of the binder resin used, the presence or absence of an external additive, and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner.

An external additive can be added to the toner so as to impart fluidity.

Specific examples of the external additives include, but are not limited to, particles of silica, hydrophobized silica, metal salts of fatty acids (e.g., zinc stearate, aluminum stearate), metal oxides (e.g., titania, alumina, tin oxide, antimony oxide) and hydrophobized products thereof, and fluoropolymers. Among these, particles of hydrophobized silica, titania, and hydrophobized titania (titanium oxide) are preferably used.

Specific examples of useable commercially available hydrophobized silicas include, but are not limited to, HDK H 2000, HDK H 2000/4, HDK H 2050EP, HVK 21, and KDK H 1303 (from Clariant Japan K. K.); and R972, R974, RX200, RY200, R202, R805, and R812 (from Nippon Aerosil Co., Ltd.). Specific examples of useable commercially available titanias include, but are not limited to, P-25 (from Nippon Aerosil Co., Ltd.); STT-30 and STT-65C-S (from Titan Kogyo K. K.); TAF-140 (from Fuji Titanium Industry Co., Ltd.); and MT-150W, MT-500B, MT-600B, and MT-150A (from Tayca Corporation). Specific examples of useable commercially available hydrophobized titanias include, but are not limited to, T-805 (from Nippon Aerosil Co., Ltd.); STT-30A and STT-65S-S (from Titan Kogyo K. K.); TAF-500T and TAF-1500T (from Fuji Titanium Industry Co., Ltd.); MT-100S and MT-100T (from Tayca Corporation); and IT-S (from Ishihara Sangyo Kaisha, Ltd.).

A hydrophilic inorganic material (such as silica, titania, alumina) can be hydrophobized by treating the hydrophilic inorganic material with a silane coupling agent such as methyl trimethoxysilane, methyl triethoxysilane, and octyl trimethoxysilane.

Specific examples of hydrophobizing agents include, but are not limited to, silane coupling agents (e.g., dialkyl dihalogenated silane, trialkyl halogenated silane, alkyl trihalogenated silane, hexaalkyl disilazane), organic titanate coupling agents, aluminum coupling agents, silicone oils, and silicone varnishes.

A silicone-oil-treated inorganic material, in which an inorganic material is treated with a silicone oil optionally upon application of heat, is also used as the external additive.

Specific examples of the inorganic material include, but are not limited to, silica, alumina, titanium oxide, barium titanate, magnesium titanate, calcium titanate, strontium titanate, iron oxide, copper oxide, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Among these, silica and titanium dioxide are preferably used.

Specific examples of the silicone oil include, but are not limited to, dimethyl silicone oil, methylphenyl silicone oil, chlorophenyl silicone oil, methylhydogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, acryl-modified silicone oil, methacryl-modified silicone oil, and α-methylstyrene-modified silicone oil.

The inorganic material preferably has an average primary particle diameter of from 1 to 100 nm, and more preferably from 3 to 70 nm. When the average primary particle diameter is too small, the inorganic material tends to be buried in the toner, and cannot exert its effect. When the average primary particle diameter is too large, the inorganic material tends to unevenly damage the surface of an image bearing member. When the inorganic material and the hydrophobized inorganic material are used in combination, the hydrophobized inorganic material preferably has an average primary particle diameter of from 1 to 100 nm, and more preferably from 5 to 70 nm. In particular, a combination of two kinds of hydrophobized inorganic materials having an average primary particle diameter of not grater than 20 nm and an inorganic material having an average primary particle diameter of not less than 30 nm is preferable. The inorganic material preferably has a BET specific surface area of from 20 to 500 $m^2/g$.

The toner preferably includes the external additive in an amount of from 0.1 to 0.5% by weight, and more preferably from 0.3 to 3% by weight.

A particulate resin can be also used as the external additive. Specific examples of the particulate resin include, but are not limited to, particles of polystyrene obtained by soap-free polymerization, suspension polymerization, and/or dispersion polymerization; copolymers of methacrylates and acrylates; polycondensation polymers such as silicone, benzoguanamine, and nylon; and thermosetting resins. A toner including such a particulate resin has better chargeability. Therefore, the product of reversely-charged toner and the occurrence of background fouling in the resultant image can be prevented. The toner preferably includes the particulate resin in an amount of from 0.01% to 5% by weight, and more preferably from 0.1% to 2% by weight.

The toner may optionally include other materials such as a fluidity improving agent, a cleanability improving agent, a magnetic material, a metal soap, and the like.

The fluidity improving agent prevents deterioration of the fluidity and charge properties of the resultant toner particularly under high humidity conditions. The fluidity improving agent can be obtained by hydrophobizing an inorganic material. Suitable hydrophobizing agents for use in the hydrophobizing treatment include, but are not limited to, silane coupling agents, silylation agents, silane coupling agents having a fluorinated alkyl group, organic titanate coupling agents, aluminum coupling agents, silicone oils, and modified silicone oils.

The cleanability improving agent adds good cleaning properties to the toner such that toner particles remaining on the surface of a photoreceptor or a primary transfer member even after a toner image is transferred can be easily removed. Specific examples of such a cleanability improving agents include, but are not limited to, metal salts of fatty acids such as zinc stearate and calcium stearate; and particulate polymers such as polymethyl methacrylate and polystyrene, which are manufactured by a method such as soap-free emulsion polymerization methods. In particular, particulate resins having a relatively narrow particle diameter distribution and a volume average particle diameter of from 0.01 μm to 1 μm are preferably used as the cleanability improving agent.

Specific examples of the magnetic material include, but are not limited to, iron powder, magnetite, and ferrite. Among these, white-colored materials are preferably used in terms of the color tone of the toner.

The toner preferably has an average circularity of from 0.90 to 0.93. When the average circularity is too small, a uniform thin toner layer cannot be formed on the developing roller because the toner includes a large amount of irregular-shaped toner particles. When the average circularity is too large, there is no need to adjust the surface roughness of the developing roller so that the toner is transported.

The shape of a particle can be determined by an optical detection method such that an image of the particle is optically detected by a CCD camera and analyzed. A particle suspension passes the image detector located on the flat plate so as to be detected.

The circularity of a particle is determined by the following equation:

$$\text{Circularity}=Cs/Cp$$

wherein Cp represents the length of the circumference of the image of a particle and Cs represents the length of the circumference of a circle having the same area as that of the image of the particle.

(Image Forming Method and Image Forming Apparatus)

A non-limiting example of an image forming apparatus that embodies the present advancement includes: an image bearing member; a charger configured to charge the surface of the image bearing member to a predetermined potential, provided in contact with the image bearing member; an irradiator configured to irradiate the charged surface of the image bearing member to form an electrostatic latent image thereon; a developing device configured to develop the electrostatic latent image with a toner to form a toner image; a transfer device configured to transfer the toner image onto a recording medium; and a fixing device configured to fix the toner image on the recording medium.

A non-limiting example of an image forming method that embodies the present advancement includes: a charging process in which a surface of an image bearing member is charged; an irradiating process in which the charged surface of the image bearing member is irradiated to form an electrostatic latent image thereon; a developing process in which the electrostatic latent image is developed with a toner to form a toner image; a transfer process in which the toner image is transferred onto a recording medium; and a fixing process in which the toner image is fixed on the recording medium.

The developing process may be performed using the above-mentioned developing device.

The material, shape, structure, and size of the image bearing member (hereinafter a photoreceptor, a photoconductor, an electrostatic latent image bearing member, etc.) are not particularly limited. The shape may be drum-like, sheet-like, endless-belt-like, etc. The structure may be single-layered or multilayered. The size may be varied according to the size and specification of an image forming apparatus used. As for the material, inorganic photoreceptors including an amorphous silicon, selenium, CdS, ZnO, etc., and organic photoreceptors (OPC) including a polysilane, a phthalopolymethine, etc., can be use as the image bearing member.

The amorphous silicone photoreceptor is prepared by heating a substrate to a temperature of from 50 to 400° C., and forming a photosensitive layer including an amorphous silicone on the substrate by a film forming method such as a vacuum evaporation method, a spattering method, an ion plating method, a thermal CVD method, an optical CVD method, and a plasma CVD method. Among these methods, a plasma CVD method is preferably used. In particular, a method in which a photosensitive layer including an amorphous silicon is formed by decomposing a raw material gas by a direct current, high frequency, or microwave glow discharging is preferably used.

The organic photoreceptors (OPC) are widely used because of having the following advantages:

(1) wide range of light-absorbing wavelength;
(2) high sensitivity and stable chargeability;
(3) capable of using various kinds of materials;
(4) ease of manufacture;
(5) low in cost; and
(6) nontoxic.

The organic photoreceptors are broadly classified into single-layered photoreceptors and multi-layered photoreceptors.

The single-layered photoreceptor includes a substrate and a single-layered photoconductive layer located overlying the substrate, and optionally includes a protective layer, an intermediate layer, etc., if desired.

The multi-layered photoreceptor includes a substrate, and a charge generation layer and a charge transport layer located overlying the substrate in this order, and optionally includes a protective layer, an intermediate layer, etc., if desired.

In the charging process, the surface of the image bearing member is uniformly charged by the charger.

Any known chargers capable of uniformly charging the surface of the image bearing member by applying a voltage thereto can be used. The chargers are broadly classified into contact chargers, which charge the image bearing member in contact therewith, and non-contact chargers, which charge the image bearing member not in contact therewith.

As the contact charger, for example, a conductive or semi-conductive charging roller, a magnetic brush, a fur brush, a film, a rubber blade, etc., can be used. Among these, the charging roller is preferably used. The use of the charging roller is capable of drastically reducing the production amount of ozone compared to corona discharge. In addition, the charging roller has stability even when repeatedly used, and therefore deterioration of the image quality can be prevented.

As the non-contact charger, for example, a non-contact charging device using corona discharge, a whisker device, a solid discharging element, a conductive or semi-conductive charging roller provided forming a fine gap between the image bearing member, etc., can be used.

In the irradiating process, the charged surface of the image bearing member is irradiated with a light beam by the irradiator to form an electrostatic latent image thereon.

The optical systems used in the irradiator are broadly classified into analog optical systems and digital optical systems. In the analog optical system, an original image is directly projected onto the image bearing member. In the digital optical system, image information is converted into an electric signal, the electric signal is then converted into an optical signal, and the image bearing member is irradiated based on the optical signal to form a latent image.

Any known irradiators capable of irradiating the charged surface of the image bearing member so that a latent image is formed thereon can be used. For example, irradiators using a radiation optical system, a rod lens array, a laser optical system, a liquid crystal shutter optical system, an LED optical system, etc., can be used.

In the transfer process, a toner image is transferred onto a recording medium. It is preferable that the toner image is firstly transferred onto an intermediate transfer member, and subsequently transferred on to the recording medium. It is more preferable that the transfer process comprises a primary transfer process in which two or more monochrome toner images, preferably in full color, are transferred onto the intermediate transfer member to form a composite toner image and a secondary transfer process in which the composite toner image is transferred onto the recording medium.

The transfer process is performed by, for example, charging a toner image formed on the image bearing member by the transfer device such as a transfer charger. The transfer device preferably includes a primary transfer device to transfer monochrome toner images onto an intermediate transfer member to form a composite toner image and a secondary transfer device to transfer the composite toner image onto a recording medium.

Any known transfer members can be used as the intermediate transfer member. For example, a transfer belt is preferably used.

The transfer device (such as the primary transfer device and the secondary transfer device) preferably includes a transferrer to separate the toner image from the image bearing member to the recording medium. The transfer device may be used alone or in combination.

As the transferrer, a corona transferrer using corona discharge, a transfer belt, a transfer roller, a pressing transfer roller, an adhesion transferrer, etc., can be used.

As the recording medium, any known recording media (recording papers) can be used.

In the fixing process, a toner image transferred onto a recording medium is fixed thereon by the fixing device. Each of monochrome toner images may be independently fixed on the recording medium. Alternatively, a composite toner image in which a monochrome toner images are overlaid one another may be fixed at once.

As the fixing device, any known heat and pressure applying devices are preferably used. As the heat and pressure applying device, a combination of a heat applying roller and a pressure applying roller, a combination of a heat applying roller, a pressure applying roller, and a seamless belt, etc., can be used.

The heat and pressure applying device preferably heats an object to a temperature of from 80 to 200° C.

The fixing device preferably fixes a toner image without oil. In other words, the fixing device needs no oil applicator to apply an oil to a fixing member.

Any known optical fixing devices may be used alone or in combination with the above-mentioned fixing device in the fixing process.

In a discharge process, charges remaining on the image bearing member are removed by applying a discharge bias to the image bearing member. The discharge process is preferably performed by a discharge device.

As the discharge device, any known dischargers capable of applying a discharge bias to the image bearing member can be used. For example, a discharge lamp is preferably used.

In a cleaning process, toner particles remaining on the image bearing member are removed by a cleaning device.

As the cleaning device, any known cleaners capable of removing toner particles remaining on the image bearing member can be used. For example, a magnetic brush cleaner, an electrostatic brush cleaner, a magnetic roller cleaner, a blade cleaner, a brush cleaner, a web cleaner, etc. can be used.

In a recycle process, the toner particles removed in the cleaning process are recycled by a recycle device.

As the recycle device, any known feeding devices can be used, for example.

In a control process, each of the above-mentioned processes is controlled by a control device.

As the control device, any known controllers capable of control the operation of each of the devices can be used. For example, a sequencer, a computer, etc., can be used.

Figure 2:
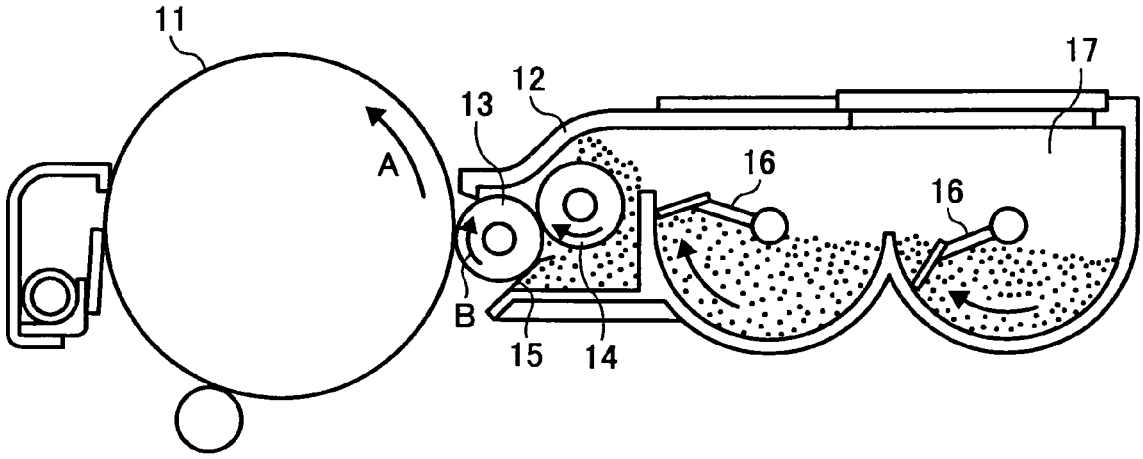
FIG. 2 is a schematic view illustrating an embodiment of the image forming apparatus including a developing device.

FIG. 2 is a schematic view illustrating an embodiment of an image forming apparatus including the developing device. An image bearing member 11 rotates in a direction indicated by an arrow A. A developing device 12 includes a developing roller 13 serving as a toner feed member provided contacting or forming a gap from 0.1 to 0.3 μm from the image bearing member 11, and rotates in a direction indicated by an arrow B.

The developing roller 13 includes a metallic conductive material such as aluminum and stainless which is sandblasted so that the surface thereof have a reasonable roughness. Around the developing roller 13, a toner supply roller 14 and a toner thickness control blade (herein after a control blade) 15 including a rubber plate (such as a urethane rubber and a silicone rubber) attached to a platy spring material or including a metallic material such as SUS are provided. Toner feed shafts 16 to supply a toner to the toner supply roller 14 are provided in a toner containing chamber 17.

(Process Cartridge)

The process cartridge is detachably attachable to the above-mentioned image forming apparatus using the above-mentioned image forming method.

The process cartridge comprises an image bearing member, a charger to charge the surface of the image bearing member to a predetermined potential, provided in contact with the image bearing member, and a developing device to develop an electrostatic latent image with a toner to form a toner image, and optionally includes a transfer device, a cleaning device, a discharging device, etc.

Figure 3:
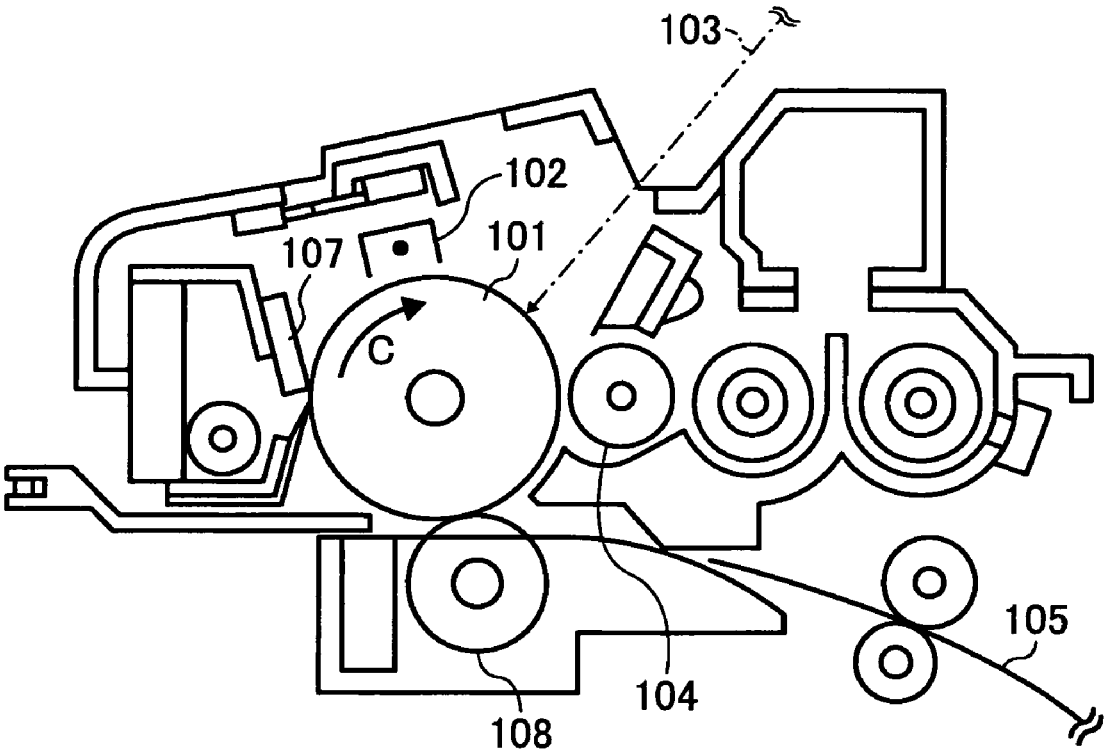
FIG. 3 is a schematic view illustrating an embodiment of a process cartridge.

FIG. 3 is a schematic view illustrating an embodiment of the process cartridge. The process cartridge illustrated in FIG. 3 includes an image bearing member 101, a charger 102, a developing device 104, a transfer device 108, and a cleaning device 107. A numeral 103 represents a light beam irradiated by an irradiator (not shown), and a numeral 105 represents a recording medium.

The image forming operation of the process cartridge will be explained. The image bearing member 101 rotates in a direction indicated by an arrow C while the charger 102 charges and the irradiator (not shown) irradiates the surface of the image bearing member 101 so that an electrostatic latent image is formed thereon. The electrostatic latent image is developed by the developing device 104 to form a toner image. The toner image is transferred onto the recording medium 105 by the transfer device 108. The recording medium 105 having the fixed toner image there on is discharged. The surface of the image bearing member 101 is cleaned with the cleaning device 107 after the toner image is transferred, and then discharged by a discharging device (not shown) to prepare for the next image forming operation.

Therefore, the occurrence of fog and density unevenness in the resultant image due to insufficient charging and feeding of a toner can be prevented, and high quality images can be stably produced.

Having generally described non-limiting embodiments of the present advancement, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis Example of First Binder Resin L1

At first, 600 g of styrene, 110 g of butyl acrylate, 30 g of acrylic acid, and 30 g of dicumyl peroxide are contained in a dropping funnel.

A 5-liter four-neck glass flask equipped with a thermometer, a stainless stirrer, a flow down condenser, and a nitrogen inlet pipe is charged with 230 g of polyoxypropylene(2,2)-2,2-bis(4-hydroxyphenyl)propane, 290 g of polyoxyethylene (2,2)-2,2-bis(4-hydroxyphenyl)propane, 250 g of isododecenyl succinic anhydride, 310 g of terephthalic acid, 180 g of 1,2,4-benzenetricarboxylic anhydride, 7 g of dibutyl tin oxide, and 340 g (i.e., 11.0 parts by weight based on 100 parts by weight of the monomers) of a paraffin wax (having a melting point of 73.3° C. and a half bandwidth of 4° C. of an endothermic peak observed when heated by a differential scanning calorimeter). The mixture contained in the four-neck glass flask is agitated at 160° C. in a mantle heater under nitrogen atmosphere, while the mixture of the vinyl monomers and the polymerization initiator is dropped therein from the dropping funnel over a period of 1 hour. The mixture is subjected to an addition polymerization reaction for 2 hours at 160° C., and subsequently heated to 230° C. so as to be subjected to a polycondensation reaction. The polymerization degree is traced by measuring a softening point of the product by a capillary rheometer. The reaction is terminated when the product has a desired softening point. Thus, a first binder resin (L1) is prepared. The first binder resin (L1) has a softening point of 130° C.

Synthesis Example of Second Binder Resin H1

A 5-liter four-neck glass flask equipped with a thermometer, a stainless stirrer, a flow down condenser, and a nitrogen inlet pipe is charged with 2210 g of polyoxypropylene(2,2)-2,2-bis(4-hydroxyphenyl)propane, 850 g of terephthalic acid, 120 g of 1,2,4-benzenetricarboxylic anhydride, and 0.5 g of dibutyl tin oxide. The mixture contained in the four-neck glass flask is heated to 230° C. in a mantle heater under nitrogen atmosphere so as to be subjected to a polycondensation reaction. The polymerization degree is traced by measuring a softening point of the product by a capillary rheometer. The reaction is terminated when the product has a desired softening point. Thus, a second binder resin (H1) is prepared. The second binder resin (H1) has a softening point of 115° C.

Toner Manufacturing Examples 1 to 4

A binder resin is prepared by mixing 6 parts of the first binder resin (L1) and 4 parts of the second binder resin (H1). A master batch including 4 parts of a naphthol colorant C. I. Pigment Red 57:1 is mixed with 100 parts of the binder resin (including the wax) using a HENSCHEL MIXER, and the mixture is melt-kneaded with a twin-screw extruder (PCM-30 from Ikegai Co., Ltd.). The kneaded mixture is rolled by a cooling press roller so that the resultant rolled mixture has a thickness of 2 mm. The rolled mixture is cooled by a cooling belt. The cooled mixture is coarsely pulverized by a feather mill, and subsequently finely pulverized by a mechanical pulverizer (KTM from Kawasaki Heavy Industries, Ltd.) so that the resultant pulverized particles have an average particle diameter of from 10 to 12 μm. The pulverized particles are subjected to a coarse classification and a pulverization using a jet pulverizer (IDS from Nippon Pneumatic Mfg. Co., Ltd.), and subsequently subjected to a fine classification using a rotor classifier (100 ATP from Hosokawa Micron Corporation). By controlling the classification revolution, magenta mother toners 1 to 4 are prepared.

Next, 100 parts by weight of each of the magenta mother toners 1 to 4 is mixed with 2.5 parts of a hydrophobized silica using a HENSCHEL MIXER. Thus, magenta toners 1 to 4 are prepared.

The volume average particle diameter (Dv), the particle diameter distribution (Dv/Dn), and the average circularity of the magenta toners 1 to 4 are measured as follows.

The volume average particle diameter (Dv) and the particle diameter distribution (Dv/Dn) of a toner is measured using an instrument COULTER MULTISIZER II (from Beckman Coulter K. K.). The measuring method is as follows:

(1) 0.1 to 5 ml of a surfactant (an alkylbenzene sulfonate) is included as a dispersant in 100 to 150 ml of an electrolyte (i.e., 1% NaCl aqueous solution including a first grade sodium chloride such as ISOTON-II from Coulter Electrons Inc.);

(2) 2 to 20 mg of a toner is added to the electrolyte and dispersed using an ultrasonic dispersing machine for about 1 to 3 minutes to prepare a toner suspension liquid;

(3) the volume and the number of the toner particles are measured by the above instrument using an aperture of 100 μm to determine volume and number distribution thereof; and (4) the volume average particle diameter (Dv) and the number average particle diameter (Dn) are determined.

The channels include 13 channels as follows: from 2.00 to less than 2.52 μm; from 2.52 to less than 3.17 μm; from 3.17 to less than 4.00 μm; from 4.00 to less than 5.04 μm; from 5.04 to less than 6.35 μm; from 6.35 to less than 8.00 μm; from 8.00 to less than 10.08 μm; from 10.08 to less than 12.70 μm; from 12.70 to less than 16.00 μm; from 16.00 to less than 20.20 μm; from 20.20 to less than 25.40 μm; from 25.40 to less than 32.00 μm; and from 32.00 to less than 40.30 μm. Namely, particles having a particle diameter of from not less than 2.00 μm to less than 40.30 μm can be measured.

The average circularity of a toner is measured using a flow-type particle image analyzer FPIA-1000 (manufactured by Sysmex Corp.). The measurement method is as follows:

(1) 0.1 to 0.5 ml of a surfactant (an alkylbenzene sulfonate) is included as a dispersant in 100 to 150 ml of water from which solid impurities have been removed;

(2) 0.1 to 0.5 g of a toner is added thereto and dispersed using an ultrasonic dispersing machine for about 1 to 3 minutes to prepare a toner suspension liquid including 3,000 to 10,000 per 1 micro-liter of the toner particles; and (3) the average circularity and circularity distribution of the toner are measured by the measuring instrument mentioned above.

The measurement results of the toners 1 to 4 are shown in Table 1.

TABLE 1

| Toner | Dv (μm) | Dv/Dn | Average Circularity |
|---|---|---|---|
| 1 | 8.0 | 1.90 | 0.915 |
| 2 | 9.0 | 1.90 | 0.908 |
| 3 | 5.5 | 1.9 | 0.940 |
| 4 | 9.0 | 2.9 | 0.897 |

Developing Roller Manufacturing Example 1

Preparation of Intermediate Layer Material

An intermediate layer material is prepared by mixing 100 parts of a silicone rubber (X-34-424 A/B from Shin-Etsu Chemical Co., Ltd.), 100 parts of another silicone rubber (X-34-387 A/B from Shin-Etsu Chemical Co., Ltd.), and 25 parts of silica particles having an average particle diameter of 10 μm. The average particle diameter of the silica particles is measured using an instrument COULTER MULTISIZER II (from Beckman Coulter K. K.).

(Preparation of Surface Layer Material)

A surface layer material is prepared by mixing 100 parts of an acrylonitrile-butadiene rubber (NBR) (NIPOL DN401 from Zeon Corporation), 1 part of γ-mercaptopropyl trimethoxysilane (A-189 from Nippon Unicar Company Limited), 0.5 parts of stearic acid (LUNAC S30 from Kao Corporation), 5 parts of zinc white (ZnO), 30 parts of acetylene black, 1.07 parts of SANCELER CZ-G (from Sanshin Chemical Industry Co., Ltd.), 0.49 parts of NOCCELER BZ-P (from Ouchi Shinko Chemical Industrial), and 1 part of sulfur powder.

(Preparation of Developing Roller)

A cored bar made of SUS 303 (having a diameter of 10 mm) is prepared as a shaft core. An adhesive agent is applied to the outermost surface of the shaft core, and then the shaft core is set inside a roller mold. The intermediate layer material is cast in a gap between the shaft core and the inner surface of the roller mold, then heated for 1 hour at 180° C. to be vulcanized, and then heated for 4 hours at 200° C. to be secondarily vulcanized. Thus, an intermediate layer having a thickness of 5 mm is formed on the outermost surface of the shaft core. The shaft core having the intermediate layer thereon is demolded. The outermost surface of the intermediate layer is subjected to a corona discharge treatment for 10 seconds using a high-frequency power supply. The distance between an electrode is 3 mm and the angle is 90 degree. A coating liquid, i.e., the surface layer material is applied to the corona-discharge-treated outermost surface of the intermediate layer, and then dried and heated. Thus, a surface layer having a thickness of 5 μm is formed on the outermost surface of the intermediate layer.

Thus, a developing roller 1 having a double-layered structure is prepared.

Developing Roller Manufacturing Example 2

The procedure for preparing the developing roller in Developing Roller Manufacturing Example 1 is repeated except that the amount of the silica particles having an average particle diameter of 10 μm included in the intermediate layer material is changed from 25 parts to 30 parts. Thus, a developing roller 2 is prepared.

Developing Roller Manufacturing Example 3

The procedure for preparing the developing roller in Developing Roller Manufacturing Example 1 is repeated except that the amount of the silica particles having an average particle diameter of 10 μm included in the intermediate layer material is changed from 25 parts to 31 parts. Thus, a developing roller 3 is prepared.

Developing Roller Manufacturing Example 4

The procedure for preparing the developing roller in Developing Roller Manufacturing Example 1 is repeated except that the amount of the silica particles having an average particle diameter of 10 μm included in the intermediate layer material is changed from 25 parts to 42 parts. Thus, a developing roller 4 is prepared.

Developing Roller Manufacturing Example 5

The procedure for preparing the developing roller in Developing Roller Manufacturing Example 1 is repeated except that the amount of the silica particles having an average particle diameter of 10 μm included in the intermediate layer material is changed from 25 parts to 50 parts. Thus, a developing roller 5 is prepared.

Developing Roller Manufacturing Example 6

The procedure for preparing the developing roller in Developing Roller Manufacturing Example 1 is repeated except that the amount of the silica particles having an average particle diameter of 10 μm included in the intermediate layer material is changed from 25 parts to 38 parts. Thus, a developing roller 6 is prepared.

Developing Roller Manufacturing Example 7

The procedure for preparing the developing roller in Developing Roller Manufacturing Example 1 is repeated except that the amount of the silica particles having an average particle diameter of 10 μm included in the intermediate layer material is changed from 25 parts to 39 parts. Thus, a developing roller 7 is prepared.

Developing Roller Manufacturing Example 8

The procedure for preparing the developing roller in Developing Roller Manufacturing Example 1 is repeated except that the amount of the silica particles having an average particle diameter of 10 μm included in the intermediate layer material is changed from 25 parts to 29 parts. Thus, a developing roller 8 is prepared.

Developing Roller Manufacturing Example 9

The procedure for preparing the developing roller in Developing Roller Manufacturing Example 1 is repeated except that the amount of the silica particles having an average particle diameter of 10 μm included in the intermediate layer material is changed from 25 parts to 23 parts. Thus, a developing roller 9 is prepared.

Developing Roller Manufacturing Example 10

The procedure for preparing the developing roller in Developing Roller Manufacturing Example 1 is repeated except that the amount of the silica particles having an average particle diameter of 10 μm included in the intermediate layer material is changed from 25 parts to 39 parts. Thus, a developing roller 10 is prepared.

Developing Roller Manufacturing Example 11

The procedure for preparing the developing roller in Developing Roller Manufacturing Example 1 is repeated except that the amount of the silica particles having an average particle diameter of 10 μm included in the intermediate layer material is changed from 25 parts to 28 parts. Thus, a developing roller 11 is prepared.

Developing Roller Manufacturing Example 12

The procedure for preparing the developing roller in Developing Roller Manufacturing Example 1 is repeated except that the amount of the silica particles having an average particle diameter of 10 μm included in the intermediate layer material is changed from 25 parts to 45 parts. Thus, a developing roller 12 is prepared.

Developing Roller Manufacturing Example 13

The procedure for preparing the developing roller in Developing Roller Manufacturing Example 1 is repeated except that the amount of the silica particles having an average particle diameter of 10 μm included in the intermediate layer material is changed from 25 parts to 56 parts. Thus, a developing roller 13 is prepared.

Developing Roller Manufacturing Example 14

The procedure for preparing the developing roller in Developing Roller Manufacturing Example 1 is repeated except that the amount of the silica particles having an average particle diameter of 10 μm included in the intermediate layer material is changed from 25 parts to 37 parts. Thus, a developing roller 14 is prepared.

Developing Roller Manufacturing Example 15

The procedure for preparing the developing roller in Developing Roller Manufacturing Example 1 is repeated except that the amount of the silica particles having an average particle diameter of 10 μm included in the intermediate layer material is changed from 25 parts to 40 parts. Thus, a developing roller 15 is prepared.

Developing Roller Manufacturing Example 16

The procedure for preparing the developing roller in Developing Roller Manufacturing Example 1 is repeated except that the amount of the silica particles having an average particle diameter of 10 μm included in the intermediate layer material is changed from 25 parts to 26 parts. Thus, a developing roller 16 is prepared.

Developing Roller Manufacturing Example 17

The procedure for preparing the developing roller in Developing Roller Manufacturing Example 1 is repeated except that the amount of the silica particles having an average particle diameter of 10 μm included in the intermediate layer material is changed from 25 parts to 29 parts. Thus, a developing roller 17 is prepared.

Developing Roller Manufacturing Example 18

The procedure for preparing the developing roller in Developing Roller Manufacturing Example 1 is repeated except that the amount of the silica particles having an average particle diameter of 10 μm included in the intermediate layer material is changed from 25 parts to 29 parts. Thus, a developing roller 18 is prepared.

Developing Roller Manufacturing Example 19

The procedure for preparing the developing roller in Developing Roller Manufacturing Example 1 is repeated except that 25 parts of the silica particles having an average particle diameter of 10 μm included in the intermediate layer material is replaced with 30 parts of silica particles having an average particle diameter of 5 μm. Thus, a developing roller 19 is prepared.

The arithmetical mean roughness (Ra) in a longitudinal direction, the ten-point mean roughness (Rz) in a longitudinal direction, and the mean length (RSm) of roughness curve elements of the developing rollers 1 to 19 are measured as follows.

The arithmetical mean roughness (Ra) and the ten-point mean roughness (Rz) each of a developing roller are measured using a contact surface roughness measuring instrument SURFCOM (from Tokyo Seimitsu Co., Ltd.) based on JIS B0601-1994.

The mean length (RSm) of roughness curve elements of a developing roller can be determined as follows. A developing roller is observed and photographed by a scanning electron microscope (SEM). Distances between 100 randomly selected particles for forming concavities and convexities are measured from the photograph and averaged.

The measurement results of the developing rollers 1 to 19 are shown in Table 2.

TABLE 2

| | | | | | Silica Particles | |
|---|---|---|---|---|---|---|
| Developing Roller | Ra (μm) | RSm (μm) | (Ra/RSm) × 100 | Rz (μm) | Average Particle Diameter (μm) | Added Amount (parts) |
| 1 | 1.31 | 33.0 | 3.97 | 9.5 | 10 | 25 |
| 2 | 1.30 | 43.6 | 2.98 | 10.2 | 10 | 30 |
| 3 | 1.60 | 42.8 | 3.74 | 10.5 | 10 | 31 |
| 4 | 1.61 | 76.9 | 2.09 | 10.0 | 10 | 42 |
| 5 | 2.22 | 109.3 | 2.03 | 9.1 | 10 | 50 |
| 6 | 2.20 | 57.5 | 3.83 | 9.9 | 10 | 38 |
| 7 | 1.50 | 59.6 | 2.52 | 10.2 | 10 | 39 |
| 8 | 1.51 | 42.5 | 3.55 | 9.4 | 10 | 29 |
| 9 | 0.91 | 20.4 | 4.46 | 10.1 | 10 | 23 |
| 10 | 0.91 | 59.3 | 1.53 | 10.3 | 10 | 39 |
| 11 | 1.62 | 33.5 | 4.84 | 9.5 | 10 | 28 |
| 12 | 1.60 | 90.4 | 1.77 | 9.4 | 10 | 45 |
| 13 | 2.21 | 118.0 | 1.87 | 10.9 | 10 | 56 |
| 14 | 2.20 | 51.8 | 4.25 | 10.3 | 10 | 37 |
| 15 | 1.20 | 64.5 | 1.86 | 9.5 | 10 | 40 |
| 16 | 1.22 | 27.9 | 4.37 | 9.2 | 10 | 26 |
| 17 | 1.20 | 30.3 | 3.96 | 10.9 | 10 | 29 |
| 18 | 1.21 | 31.5 | 3.84 | 19.9 | 10 | 29 |
| 19 | 0.46 | 24.0 | 1.92 | 5.2 | 10 | 30 |

Examples 1 to 8 and Comparative Examples 1 to 13

A toner and a developing roller described in Table 3 are mounted on a color laser printer (IPSIO 3000 from Ricoh Co., Ltd.), adopting an oilless fixing system (IH fixing system), in combination.

A running test in which 3 sheets of an image having an image proportion of 3% is produced on an A4-size paper per 1 job is performed. The produced image is evaluated as follows.

(1) Evaluation of Fog

After the running test is performed, a white solid image is produced. The white solid image is visually observed and whiteness of the image is evaluated as follows.

Good: Good quality. No problem in practical use.

Average: Average quality. No problem in practical use.

Poor: Having problem in practical use.

(2) Evaluation of White Line

After the running test is performed, a half-tone image is produced. The half-tone image is visually observed whether white lines in a longitudinal direction are formed or not, and evaluated as follows.

Good: Good quality. No problem in practical use.

Average: Average quality. No problem in practical use.

Poor: Having problem in practical use.

(3) Evaluation of Unevenness

After the running test is performed, a solid image is produced. The solid image is visually observed and evenness of the image is evaluated as follows.

Good: Good quality. No problem in practical use.

Average: Average quality. No problem in practical use.

Poor: Having problem in practical use

The combinations of the toners and the developing rollers are shown in Table 3 and the evaluation results are shown in Table 4.

TABLE 3

| | Toner | Developing roller |
|---|---|---|
| Example 1 | Toner 1 | Developing roller 1 |
| Example 2 | Toner 1 | Developing roller 2 |
| Example 3 | Toner 1 | Developing roller 3 |
| Example 4 | Toner 1 | Developing roller 4 |
| Example 5 | Toner 2 | Developing roller 5 |
| Example 6 | Toner 2 | Developing roller 6 |
| Example 7 | Toner 2 | Developing roller 7 |
| Example 8 | Toner 2 | Developing roller 8 |
| Comparative Example 1 | Toner 1 | Developing roller 9 |
| Comparative Example 2 | Toner 1 | Developing roller 10 |
| Comparative Example 3 | Toner 1 | Developing roller 11 |
| Comparative Example 4 | Toner 1 | Developing roller 12 |
| Comparative Example 5 | Toner 2 | Developing roller 13 |
| Comparative Example 6 | Toner 2 | Developing roller 14 |
| Comparative Example 7 | Toner 2 | Developing roller 15 |
| Comparative Example 8 | Toner 2 | Developing roller 16 |
| Comparative Example 9 | Toner 2 | Developing roller 17 |
| Comparative Example 10 | Toner 2 | Developing roller 18 |
| Comparative Example 11 | Toner 2 | Developing roller 19 |
| Comparative Example 12 | Toner 3 | Developing roller 13 |
| Comparative Example 13 | Toner 4 | Developing roller 13 |

TABLE 4

| | Dv (μm) | Ra (μm) | Formula (1)(*) | Fog | White line | Unevenness |
|---|---|---|---|---|---|---|
| Ex. 1 | 8 | 1.31 | 1.28 to 2.88 | Good | Good | Good |
| Ex. 2 | 8 | 1.30 | 1.28 to 2.88 | Good | Good | Good |
| Ex. 3 | 8 | 1.60 | 1.28 to 2.88 | Good | Good | Good |
| Ex. 4 | 8 | 1.61 | 1.28 to 2.88 | Good | Good | Good |
| Ex. 5 | 9 | 2.22 | 1.44 to 3.24 | Good | Good | Good |
| Ex. 6 | 9 | 2.20 | 1.44 to 3.24 | Good | Good | Good |
| Ex. 7 | 9 | 1.50 | 1.44 to 3.24 | Good | Good | Good |
| Ex. 8 | 9 | 1.51 | 1.44 to 3.24 | Good | Good | Good |
| Comp. Ex. 1 | 8 | 0.91 | 1.28 to 2.88 | Average | Good | Average |
| Comp. Ex. 2 | 8 | 0.91 | 1.28 to 2.88 | Good | Average | Good |
| Comp. Ex. 3 | 8 | 1.62 | 1.28 to 2.88 | Average | Good | Average |
| Comp. Ex. 4 | 8 | 1.60 | 1.28 to 2.88 | Good | Average | Good |
| Comp. Ex. 5 | 9 | 2.21 | 1.44 to 3.24 | Good | Average | Good |
| Comp. Ex. 6 | 9 | 2.20 | 1.44 to 3.24 | Average | Good | Average |
| Comp. Ex. 7 | 9 | 1.20 | 1.44 to 3.24 | Good | Average | Good |
| Comp. Ex. 8 | 9 | 1.22 | 1.44 to 3.24 | Average | Good | Average |

TABLE 4-continued

| | Dv (μm) | Ra (μm) | Formula (1)(*) | Fog | White line | Unevenness |
|---|---|---|---|---|---|---|
| Comp. Ex. 9 | 9 | 1.20 | 1.44 to 3.24 | Average | Good | Average |
| Comp. Ex. 10 | 9 | 1.21 | 1.44 to 3.24 | Good | Average | Good |
| Comp. Ex. 11 | 9 | 0.46 | 1.44 to 3.24 | Good | Poor | Average |
| Comp. Ex. 12 | 5.5 | 2.21 | 0.88 to 1.98 | Good | Average | Poor |
| Comp. Ex. 13 | 9 | 2.21 | 1.44 to 3.24 | Good | Average | Poor |

(*) $0.08 \times 10^{0.3} \times Dv < Ra < 0.18 \times 10^{0.3} \times Dv$, $10^{0.3} = 2$

Having now fully described non-limiting embodiments of the present amendment, it will be apparent to one of ordinary skill in the art that many changes and modifications can be made thereto without departing from the spirit and scope of the advancement as set forth therein.

What is claimed is:

1. A developing device, comprising:

a developing roller provided facing an image bearing member; and a toner layer thickness control member configured to control an amount of a toner adhered to the developing roller, so that an electrostatic latent image formed on the image bearing member is developed with the toner to form a toner image, wherein the following relationships are satisfied:

$$0.08\times10^{0.3}\times Dv<Ra<0.18\times10^{0.3}\times Dv \quad (1)$$

$$2.0<(Ra/RSm)\times100<4.0 \quad (2)$$

$$8<Rz<15 \quad (3)$$

wherein Dv (μm) represents a volume average particle diameter of the toner, Ra (μm) represents an arithmetical mean roughness of the developing roller in a longitudinal direction, Rz (μm) represents a ten-point mean roughness of the developing roller in a longitudinal direction, and RSm (μm) represents a mean length of roughness curve elements of the developing roller, and the toner has a ratio (Dv/Dn) of a volume average particle diameter (Dv) to a number average particle diameter (Dn) from 1.8 to 2.5.

2. The developing device according to claim 1, wherein the developing roller comprises:

a shaft core;

an intermediate layer located overlying an outermost surface of the shaft core and comprising a particulate material that forms concavities and convexities on the surface of the developing roller; and a surface layer located overlying an outermost surface of the intermediate layer.

3. The developing device according to claim 2, wherein the particulate material has a number average particle diameter from 8 to 12 μm.

4. The developing device according to claim 1, wherein the toner is prepared by a method comprising:

melt-kneading toner components comprising a binder resin and a colorant; and pulverizing the melt-kneaded toner components.

5. The developing device according to claim 1, wherein the toner has an average circularity from 0.90 to 0.93 and a volume average particle diameter (Dv) from 6 to 10 μm.

6. An image forming method, comprising:

providing a developing roller facing an image bearing member;

charging a surface of the image bearing member;

irradiating the charged surface of the image bearing member to form an electrostatic latent image thereon;

developing the electrostatic latent image with a toner to form a toner image;

controlling an amount of a toner adhered to the developing roller, so that an electrostatic latent image formed on the image bearing member is developed with the toner to form a toner image, wherein the following relationships are satisfied:

$$0.08\times10^{0.3}\times Dv<Ra<0.18\times10^{0.3}\times Dv \quad (1)$$

$$2.0<(Ra/RSm)\times100<4.0 \quad (2)$$

$$8<Rz<15 \quad (3);$$

transferring the toner image onto a recording medium; and fixing the toner image on the recording medium, wherein Dv (μm) represents a volume average particle diameter of the toner, Ra (μm) represents an arithmetical mean roughness of the developing roller in a longitudinal direction, Rz (μm) represents a ten-point mean roughness of the developing roller in a longitudinal direction, and RSm (μm) represents a mean length of roughness curve elements of the developing roller, and the toner has a ratio (Dv/Dn) of a volume average particle diameter (Dv) to a number average particle diameter (Dn) from 1.8 to 2.5.

7. The image forming method according to claim 6, wherein the developing roller comprises:

a shaft core;

an intermediate layer located overlying an outermost surface of the shaft core and comprising a particulate material for forming concavities and convexities on the surface of the developing roller; and a surface layer located overlying an outermost surface of the intermediate layer.

8. The image forming method according to claim 7, wherein the particulate material has a number average particle diameter of from 8 to 12 μm.

9. The image forming method according to claim 6, wherein the toner is prepared by a method comprising:

melt-kneading toner components comprising a binder resin and a colorant; and pulverizing the melt-kneaded toner components.

10. The image forming method according to claim 6, wherein the toner has an average circularity from 0.90 to 0.93 and a volume average particle diameter (Dv) from 6 to 10 μm.

11. A process cartridge, comprising:

an image bearing member configured to bear an electrostatic latent image; and the developing device according to claim 1 configured to develop the electrostatic latent image with a toner to form a toner image.

12. The process cartridge according to claim 11, wherein the developing roller comprises:

a shaft core;

an intermediate layer located overlying an outermost surface of the shaft core and comprising a particulate material for forming concavities and convexities on the surface of the developing roller; and a surface layer located overlying an outermost surface of the intermediate layer.

13. The process cartridge according to claim 12, wherein the particulate material has a number average particle diameter from 8 to 12 μm.

14. The process cartridge according to claim 11, wherein the toner is prepared by a method comprising:

melt-kneading toner components comprising a binder resin and a colorant; and pulverizing the melt-kneaded toner components.

15. The process cartridge according to claim 11, wherein the toner has an average circularity from 0.90 to 0.93 and a volume average particle diameter (Dv) from 6 to 10 μm.

* * * * *